US008360824B2

(12) United States Patent
Harada et al.

(10) Patent No.: US 8,360,824 B2
(45) Date of Patent: Jan. 29, 2013

(54) METHOD OF PROCESSING SYNTHETIC QUARTZ GLASS SUBSTRATE FOR SEMICONDUCTOR

(75) Inventors: Daijitsu Harada, Joetsu (JP); Masaki Takeuchi, Joetsu (JP); Harunobu Matsui, Joetsu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 286 days.

(21) Appl. No.: 12/693,751

(22) Filed: Jan. 26, 2010

(65) Prior Publication Data

US 2010/0190414 A1 Jul. 29, 2010

(30) Foreign Application Priority Data

Jan. 27, 2009 (JP) ..... 2009-015542
Aug. 18, 2009 (JP) ..... 2009-189393

(51) Int. Cl.
*B24B 1/00* (2006.01)

(52) U.S. Cl. ..... 451/41; 451/5; 451/11; 451/57; 451/60; 451/124; 451/150

(58) Field of Classification Search ..... 451/41, 451/57, 60, 58, 389, 11, 231, 119, 236, 124, 451/150

See application file for complete search history.

(56) References Cited

U.S. PATENT DOCUMENTS 4,128,968 A 12/1978 Jones
4,735,019 A * 4/1988 Wiederkehr ..... 451/340
5,033,237 A * 7/1991 Slough et al. ..... 451/5
5,816,896 A * 10/1998 Schouwenaars ..... 451/41
5,895,311 A * 4/1999 Shiotani et al. ..... 451/5
6,106,369 A * 8/2000 Konishi et al. ..... 451/41
6,171,175 B1 * 1/2001 Shaikh et al. ..... 451/28
6,361,647 B1 * 3/2002 Halley ..... 156/345.1
6,500,060 B2 * 12/2002 Hanosh ..... 451/496
6,602,110 B2 * 8/2003 Yi et al. ..... 451/9
6,790,129 B2 * 9/2004 Moriya et al. ..... 430/5

(Continued)

FOREIGN PATENT DOCUMENTS

EP 0 724 199 A1 7/1996
JP 2000-117608 * 4/2000

(Continued)

OTHER PUBLICATIONS

Extended European search report issued on Apr. 13, 2010 in corresponding European Application No. 10 25 0131.

(Continued)

*Primary Examiner* — George Nguyen
(74) *Attorney, Agent, or Firm* — Birch, Stewart, Kolasch & Birch, LLP

(57) ABSTRACT

Disclosed is a method of processing a synthetic quartz glass substrate for a semiconductor, wherein a polishing part of a rotary small-sized processing tool is put in contact with a surface of the synthetic quartz glass substrate in a contact area of 1 to 500 $mm^2$, and is scanningly moved on the substrate surface while being rotated so as to polish the substrate surface. When the method is applied to the production of a synthetic quartz glass such as one for a photomask substrate for use in photolithography which is important to the manufacture of ICs or the like, a substrate having an extremely excellent flatness and capable of being used even with the EUV lithography can be obtained comparatively easily and inexpensively.

14 Claims, 6 Drawing Sheets

U.S. PATENT DOCUMENTS

| | | | | |
|---|---|---|---|---|
| 6,796,877 | B1 * | 9/2004 | Bingham et al. | 451/5 |
| 6,855,908 | B2 | 2/2005 | Takeuchi et al. | |
| 7,413,832 | B2 * | 8/2008 | Koike et al. | 430/5 |
| 7,455,785 | B2 | 11/2008 | Koike et al. | |
| 7,494,305 | B2 * | 2/2009 | Riall et al. | 409/132 |
| 7,637,802 | B2 * | 12/2009 | Yasuoka et al. | 451/56 |
| 8,118,642 | B2 * | 2/2012 | Coulon et al. | 451/7 |
| 2002/0081943 | A1 | 6/2002 | Hendron et al. | |
| 2003/0128344 | A1 | 7/2003 | Nishi | |
| 2004/0185750 | A1 * | 9/2004 | Kurogouchi | 451/5 |
| 2005/0186691 | A1 * | 8/2005 | Koike et al. | 438/14 |
| 2007/0125747 | A1 | 6/2007 | Otsuka et al. | |
| 2008/0075949 | A1 * | 3/2008 | Kirst et al. | 428/332 |
| 2010/0056026 | A1 * | 3/2010 | Shirota et al. | 451/41 |

FOREIGN PATENT DOCUMENTS

| | | | |
|---|---|---|---|
| JP | 2002-316835 | A | 10/2002 |
| JP | 2004-29735 | A | 1/2004 |
| JP | 2006-8426 | A | 1/2006 |

OTHER PUBLICATIONS

H. Cheng et al., "Design of a six-axis high precision machine tool and its application in machining aspherical optical mirrors," International Journal of Machine Tools & Manufacture, vol. 45, pp. 1085-1094, 2005.

R.A. Jones, "Optimization of computer controlled polishing," Applied Optics, vol. 16, No. 1, pp. 218-224, Jan. 1977.

* cited by examiner

METHOD OF PROCESSING SYNTHETIC QUARTZ GLASS SUBSTRATE FOR SEMICONDUCTOR

CROSS-REFERENCE TO RELATED APPLICATION

This non-provisional application claims priority under 35 U.S.C.§119(a) on Patent Application Nos. 2009-015542 and 2009-189393 filed in Japan on Jan. 27, 2009 and Aug. 18, 2009, respectively, the entire contents of which are hereby incorporated by reference.

TECHNICAL FIELD

The present invention relates to a method of processing a synthetic quartz glass substrate for a semiconductor, particularly a silica glass substrate for a reticle and a glass substrate for a nano-imprint, which are materials for most advanced applications, among semiconductor-related electronic materials.

BACKGROUND ART

Examples of quality of a synthetic quartz glass substrate include the size and density of defects on the substrate, flatness of the substrate, surface roughness of the substrate, photochemical stability of the substrate material, and chemical stability of the substrate surface. Requirements in regard of these qualities have been becoming severer, attendant on the trend toward higher precisions of the design rule. In a lithographic technology using an ArF laser light source with a wavelength of 193 nm and in a lithographic technology based on a combination of the ArF laser light source with an immersion technique, a silica glass substrate for a photomask is required to have good flatness. In this case, it is necessary to provide a glass substrate which not only shows a good flatness value simply but also has such a shape as to realize a flat exposure surface of the photomask at the time of exposure. In fact, if the exposure surface is not flat at the time of exposure, a shift of focus on the silicon wafer would be generated to worsen the pattern uniformity, making it impossible to form a fine pattern. Besides, the flatness of the substrate surface at the time of exposure that is required for the ArF immersion lithography is said to be not more than 250 nm.

Similarly, an EUV lithography in which a wavelength of 13.5 nm in the soft X-ray wavelength region is used as a light source has been being developed as a next-generation lithographic technology. In this technology, also, the surface of a reflection-type mask substrate is demanded to be remarkably flat. The flatness of the mask substrate surface required for the EUV lithography is said to be not more than 50 nm.

The current flatness-improving technique for silica glass substrates for photomasks is an extension of the traditional polishing technology, and the surface flatness which can substantially be realized is at best about 0.3 μm on average for 6025 substrates. Even if a substrate with a flatness of less than 0.3 μm could be obtained, the yield of such a substrate would necessarily be extremely low. The reason lies in that according to the conventional polishing technology, it is practically impossible to form recipes of flatness improvement based on the shapes of raw material substrates and to individually polish the substrates for improving the flatness, although it is possible to generally control the polishing rate over the whole surface of each substrate. Besides, for example, in the case of using a double side polishing machine of a batch processing type, it is extremely difficult to control the within-batch and batch-to-batch variations of flatness. On the other hand, in the case of using a single side polishing machine of a single wafer processing type, variations of flatness would arise from the shapes of the raw material substrates. In either case, therefore, it has been difficult to stably produce excellently flat substrates.

In the above-mentioned circumstances, a few processing methods aiming at improvement in surface flatness of glass substrates have been proposed. For instance, JP-A 2002-316835 (Patent Document 1) describes a method of improving the flatness of a surface substrate by applying local plasma etching to the substrate surface. In addition, JP-A 2006-08426 (Patent Document 2) describes a method of improving the flatness of a surface substrate by etching the substrate surface by use of a gas cluster ion beam. Further, US Patent Application 2002/0081943 A1 (Patent Document 3) proposes a method of improving the flatness of substrate surface by use of a polishing slurry containing a magnetic fluid.

In the cases of improving the flatness of a substrate surface by use of these novel technologies, however, there are such problems as large or intricate equipment and raised processing costs. For example, in the cases of plasma etching and gas cluster ion etching, the processing apparatus would be expensive and large in size, and many auxiliary equipments such as an etching gas supplying equipment, a vacuum chamber and a vacuum pump are needed. Even if the real processing time can be shortened, therefore, the total time taken for the intended improvement of flatness would be prolonged, taking into account the times taken for preparation for the processing, such as the rise times of the equipments, the time of drawing a vacuum, etc., and the times for pretreatment and post-treatment of the glass substrate. Furthermore, when depreciation expenses of the equipments and the costs of expendables, such as expensive gases (e.g., $SF_6$) consumed in each run of processing, are passed onto the price of the mask-forming glass substrate, the improved-flatness substrate would necessarily be high in price. In the lithography industry, also, the substantial rise in the price of masks is deemed as a significant problem. Therefore, a rise in the price of the glass substrates for masks is undesirable.

In addition, JP-A 2004-29735 (Patent Document 4) proposes a substrate surface flatness-improving technology in which the pressure control means of a single side polishing machine is advanced and local pressing from the side of a backing pad is adopted to thereby control the surface shape of a substrate being processed. This flatness-improving technology is on the extension of an existing polishing technology, and is considered to be comparatively inexpensive to carry out. In this method, however, the pressing is from the back side of the substrate, so that the polishing action would not reach a protuberant portion of the face-side surface locally and effectively. Therefore, the substrate surface flatness obtained by this method is at best about 250 nm. Accordingly, the use of this flatness-improving method alone is insufficient in capability as a technology for producing a mask of the EUV lithography generation.

CITATION LIST

Patent Document 1: JP-A 2002-316835
Patent Document 2: JP-A 2006-08426
Patent Document 3: US 2002/0081943 A1
Patent Document 4: JP-A 2004-29735

SUMMARY OF THE INVENTION

The present invention has been made in consideration of the above-mentioned circumstances. Accordingly, it is an object of the invention to provide a method of processing a synthetic quartz glass substrate for a semiconductor by which it is possible to produce, comparatively easily and inexpensively, a synthetic quartz glass substrate having such an extremely excellent flatness as to be consistent with the EUV lithography.

In order to attain the above object, the present inventors made intensive and extensive investigations. As a result of the investigations, they found out that polishing a substrate surface by use of a small-sized processing tool rotated by a motor is effective in solving the above-mentioned problems. Based on the finding, the present invention has been completed.

According to the present invention, there is provided a method of processing a synthetic quartz glass substrate for a semiconductor, including putting a polishing part of a rotary small-sized processing tool in contact with a surface of the synthetic quartz glass substrate in a contact area of 1 to 500 $mm^2$, and scanningly moving the polishing part on the substrate surface while rotating the polishing part so as to polish the substrate surface.

In the processing method, preferably, the rotational speed of the processing tool is 100 to 10,000 rpm, and the processing pressure is 1 to 100 $g/mm^2$.

The polishing of the substrate surface by the polishing part of the processing tool, preferably, is carried out while supplying abrasive grains.

The polishing may be carried out by use of a rotary small-sized processing tool which has a rotational axis set in a direction inclined relative to a normal to the substrate surface.

Preferably, the angle of the rotational axis of the processing tool against the normal to the substrate surface is 5 to 85°.

A section of processing by the rotary small-sized processing tool, preferably, has a shape which can be approximated by a Gaussian profile.

Preferably, the processing tool is put into reciprocating motion in a fixed direction on the substrate surface, and is advanced at a predetermined pitch in a direction perpendicular to the direction of the reciprocating motion on a plane parallel to the substrate surface, as the polishing proceeds.

The reciprocating motion may be performed in parallel to the direction of a projected line obtained by projecting the rotational axis of the processing tool onto the substrate.

The contact pressure of the processing tool against the substrate surface, preferably, is controlled to a predetermined value in performing the polishing.

Preferably, the flatness $F_1$ of the substrate surface immediately before the polishing by the processing tool is 0.3 to 2.0 μm, the flatness $F_2$ of the substrate surface immediately after the polishing by the processing tool is 0.01 to 0.5 μm, and $F_1>F_2$.

The hardness of the polishing part of the processing tool may be in the range of A50 to A75, as measured according to JIS K 6253.

Preferably, after the substrate surface is processed by the processing tool, single substrate type polishing or double side polishing is conducted so as to improve surface properties and defect in quality of a final finished surface.

Preferably, in the step of polishing performed after the polishing of the substrate surface by the processing tool in order to improve the surface properties and defect in quality of the processed surface, the polishing step is carried out by preliminarily determining the amount of polish by the small-sized processing tool through taking into account a shape change expected to be generated in the process of the polishing step, so as to attain both a good flatness and a high surface perfectness in a final finished surface.

The processing by the processing tool may be applied to both sides of the substrate so as to reduce dispersion of thickness.

ADVANTAGEOUS EFFECTS OF INVENTION

When the processing method according to the present invention is applied to the production of a synthetic quartz glass such as one for a photomask substrate for use in photolithography which is important to the manufacture of ICs or the like, a substrate which has an extremely excellent flatness and is capable of coping even with the EUV lithography can be obtained comparatively easily and inexpensively.

In addition, when the small-sized processing tool having the above-mentioned specified hardness is used, it is possible to obtain a substrate having an improved flatness which has few defects such as polish flaw.

DETAILED DESCRIPTION OF THE PREFERRED EMBODIMENTS

Figure 1:
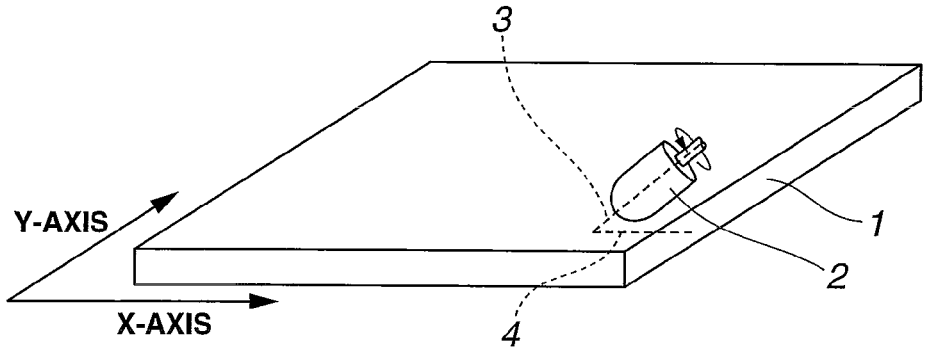
FIG. 1 is a schematic view illustrating a mode of contact of a processing tool of a partial polishing machine in the present invention.

The method of processing a synthetic quartz glass substrate for a semiconductor according to the present invention is a processing method by which to improve the surface flatness of a glass substrate. Specifically, the processing method is a polishing method in which a small-sized processing tool rotated by a motor is put in contact with a surface of the glass substrate and is scanningly moved on the substrate surface, with the contact area between the small-sized processing tool and the substrate being set in the range of 1 to 500 $mm^2$.

Here, the synthetic quartz glass substrate to be polished is a synthetic quartz glass substrate for a semiconductor which is used for manufacture of a photomask substrate, particularly the manufacture of a photomask substrate for use in a lithography in which an ArF laser light source is used or for use in EUV lithography. Though the size of the glass substrate is selected as required, the surface to be polished of the glass substrate preferably has an area of 100 to 100,000 $mm^2$, more preferably 500 to 50,000 $mm^2$, further preferably 1,000 to 25,000 $mm^2$. For instance, as a quadrilateral glass substrate, a 5009 or 6025 substrate is preferably used. As a circular glass substrate, a 6 inchϕ or 8 inchϕ wafer or the like is preferably used. When it is attempted to process a glass substrate having an area of less than 100 $mm^2$, the contact area of the rotary small-sized tool is too large in relation to the substrate, so that it may be impossible to improve the flatness of the substrate. On the other hand, when it is tried to process a glass substrate having an area of more than 100,000 $mm^2$, the contact area of the rotary small-sized tool is too small in relation to the substrate, so that the processing time will be very long.

The synthetic quartz glass substrate to be polished by the processing method of the present invention can be obtained from a synthetic quartz glass ingot by forming (molding), annealing, slicing, lapping, and rough polishing.

In the present invention, as a method for obtaining a glass having an improved flatness, a partial polishing technique using a small-sized rotary processing tool is adopted. In the present invention, first, the rugged shape of the glass substrate surface is measured. Then, a partial polishing treatment is applied to the substrate surface while controlling the polish amount according to the degrees of protuberance of protuberant portions, namely, while locally varying the polish amount so that the polish amount is larger at more protuberant portions and the polish amount is smaller at less protuberant portions, whereby the substrate surface is improved in flatness.

Therefore, the raw material glass substrate has preliminarily to be subjected to measurement of surface shape. The surface shape may be measured by any method. In consideration of the target flatness, it is desired that the measurement is high in precision, and the measuring method may be an optical interference method, for example. According to the surface shape of the raw material glass substrate, the moving speed of the rotary processing tool, for example, is computed. Then, the moving speed is controlled to be lower in the areas of the more protuberant portions so that the polish amount will be greater in the areas of the more protuberant portions.

In this case, the glass substrate, the surface of which is to be polished by the small-sized processing tool so as to improve the flatness according to the present invention, is preferably a glass substrate having a flatness $F_1$ of 0.3 to 2.0 μm, particularly 0.3 to 0.7 μm. In addition, the glass substrate preferably has a parallelism (thickness variation) of 0.4 to 4.0 μm, particularly 0.4 to 2.0 μm.

Incidentally, from the viewpoint of measurement precision, the measurement of flatness in the present invention is desirably carried out by an optical interference method utilizing the phenomenon in which, when a coherent light such as a laser light is radiated onto and reflected from the substrate surface, a difference in height of the substrate surface is observed as a phase shift of the reflected light. For example, the flatness can be measured by a flatness measuring system Ultra Flat M200, produced by Tropel Corp. Besides, the parallelism can be measured, for example, by use of a parallelism measuring system Zygo Mark IVxp, produced by Zygo Corporation.

According to the present invention, the polishing part of the rotary small-sized processing tool is put in contact with the surface of the glass substrate prepared as above, and the polishing part is scanningly moved on the substrate surface while being rotated, whereby the substrate surface is polished.

The rotary small-sized processing tool may be any one insofar as the polishing part thereof is a rotating member having a polishing ability. Examples of the system of the rotary small-sized processing tool include a system in which a small-sized platen is perpendicularly pressed against the substrate surface from above and rotated about an axis perpendicular to the substrate surface, and a system in which a rotary processing tool mounted to a small-sized grinder is pressed against the substrate surface by pressing it from a skew direction.

As for the hardness of the processing tool, the following is to be noted. If the hardness of the polishing part of the tool is less than A50, pressing the tool against the substrate surface would result in deformation of the tool, making it difficult to achieve ideal polishing. If the hardness is more than A75, on the other hand, generation of scratches (flaws) on the substrate is liable to occur in the polishing step, due to the high hardness of the tool. From this point of view, it is desirable to perform the polishing by use of a processing tool having a hardness in the range of A50 to A75. Incidentally, the hardness herein is measured according to JIS K 6253. In this case, the material of the processing tool is not particularly limited, insofar as at least the polishing part of the processing tool can process, or can remove material of, the work to be polished. Examples of the material of the polishing part include GC grindstone, WA grindstone, diamond grindstone, cerium grindstone, cerium pad, rubber grindstone, felt buff, and polyurethane. Examples of the shape of the polishing part of the rotary tool include a circular or annular flat plate-like shape, a cylindrical shape, a cannonball-like shape, a disc shape, and a barrel-like shape.

In this case, the contact area between the processing tool and the substrate is of importance. The contact area is in the range of 1 to 500 $mm^2$, preferably 2.5 to 100 $mm^2$, more preferably 5 to 50 $mm^2$. In the case where the protuberant portions of the substrate surface constitute undulation with a minute space wavelength, too large a contact area between the processing tool and the substrate leads to polishing of regions protruding from the areas of the protuberant portions to be removed. Consequently, not only the undulation would be left unremoved but also the flatness would be damaged. Besides, in the case of processing the substrate surface near a substrate end face, too large a tool size results in that when part of the tool protrudes from the substrate, the pressure at the tool's contacting portion remaining on the substrate may be raised, making it difficult to achieve the intended improvement of flatness. When the contact area is too small, too high a pressure is exerted in the region of polishing, which may cause generation of scratches (flaws) on the substrate surface. Besides, in this case, the moving distance of the tool on the substrate is enlarged, leading to a longer partial-polishing time, which naturally is undesirable.

In performing the polishing by putting the small-sized rotary processing tool in contact with the surface part of the above-mentioned protuberant portions, the processing is preferably carried out in a condition where a slurry containing abrasive grains for polishing is intermediately present. A glass substrate having an improved flatness can be obtained by controlling one or more of the moving speed, the rotational speed and the contact pressure of the small-sized rotary processing tool according to the degrees of protuberance of the surface of the raw material glass substrate, in moving the processing tool on the glass substrate.

In this case, examples of the abrasive grains for polishing include grains of silica, ceria, alundum, white alundum (WA), FO, zirconia, SiC, diamond, titania, and germania. The grain size of these abrasive grains is preferably 10 nm to 10 μm, and aqueous slurries of these grains can be used suitably. In addition, the moving speed of the processing tool is not particularly limited, and is selected as required. Normally, the moving speed can be selected in the range of 1 to 100 mm/s. The rotational speed of the polishing part of the processing tool is preferably 100 to 10,000 rpm, more preferably 1,000 to 8,000 rpm, and further preferably 2,000 to 7,000 rpm. If the rotational speed is too low, the processing rate would be low, and it would take much time to process the substrate. If the rotational speed is too high, on the other hand, the processing rate would be so high and the tool would be worn so severely as to make it difficult to control the flatness-improving process. Besides, the pressure when the polishing part of the processing tool makes contact with the substrate is preferably 1 to 100 g/mm$^2$, particularly 10 to 100 g/mm$^2$. If the pressure is too low, the polishing rate would be so low that too much time is taken to process the substrate. If the pressure is too high, on the other hand, the processing rate would be so high as to make it difficult to control the flatness-improving process, or would cause generation of large scratches (flaws) upon mixing of foreign matter to the tool or into the slurry.

Figure 2:
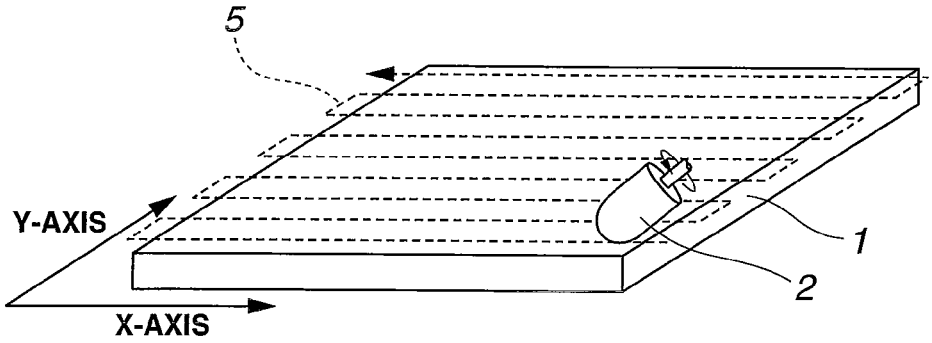
FIG. 2 is a schematic view illustrating a preferred embodiment of the mode of the movement of the processing tool of the partial polishing machine in the present invention.

Incidentally, the above-mentioned control of the moving speed of the processing tool for partial polishing according to the degrees of protuberance of protuberant portions of the surface of the raw material glass substrate can be achieved by use of a computer. In this case, the movement of the processing tool is a movement relative to the substrate, and, accordingly, the substrate itself may be moved. As for the moving direction of the processing tool, a structure may be adopted in which the processing tool can be arbitrarily moved in X-direction and Y-direction in the condition where an X-Y plane is supposed on the substrate surface. Now, a case is assumed in which, as shown in FIG. 1, the rotary processing tool 2 is put in contact with the substrate 1 from an inclined direction relative to the substrate 1, and the direction of a projected line obtained by projecting the rotational axis of the processing tool 2 onto the substrate surface is taken as the X-axis on the substrate surface. In this case, the polishing is preferably conducted as follows. First, as shown in FIG. 2, the rotary tool 2 is scanningly moved in the X-axis direction while keeping constant its position in the Y-axis direction. Thereafter, the tool 2 is minutely moved in the Y-axis direction at a fine pitch at the timing of reaching an end of the substrate 1. Then, again, the tool 2 is scanningly moved in the X-axis direction while keeping constant its position in the Y-axis direction. By repeating these operations, the whole part of the substrate 1 is polished. Incidentally, numeral 3 in FIG. 1 denotes the direction of the rotational axis of the processing tool 2, and numeral 4 denotes the straight line obtained by projecting the rotational axis 3 onto the substrate 1. In addition, numeral 5 in FIG. 2 denotes the manner in which the processing tool 2 is moved. Here, it is preferable that the rotational axis of the rotary processing tool 2 is set to be inclined relative to the normal to the substrate 1, during the polishing. In this case, the angle of the rotational axis of the tool 2 against the normal to the substrate 1 is 5 to 85°, preferably 10 to 85°, more preferably 15 to 60°. When the angle is less than 5°, the contact area is so large that it is structurally difficult to exert a uniform pressure on the whole part of the surface contacted and that it is difficult to control the flatness. When the angle is more than 85°, on the other hand, the situation is close to the case of perpendicularly pressing the tool 2 against the substrate; therefore, the shape of profile is worsened, and it becomes difficult to obtain a surface having an improved flatness even if the polishing strokes are superposed at a fixed pitch. The good or bad condition of the profile will be described in detail in the next paragraph.

Figure 3:
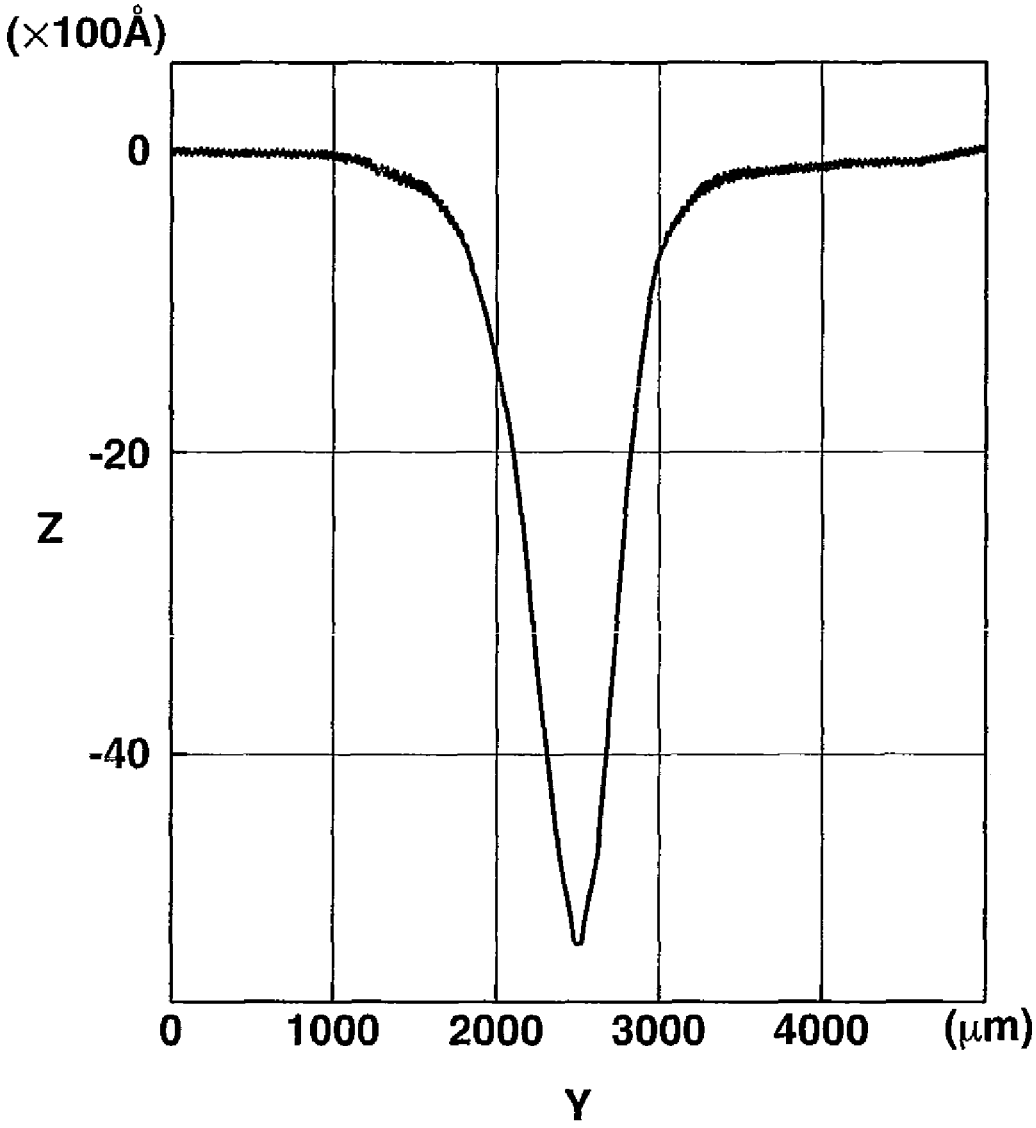
FIG. 3 is a diagram showing a section of processing obtained in the embodiment shown in FIG. 2.
Figure 4:
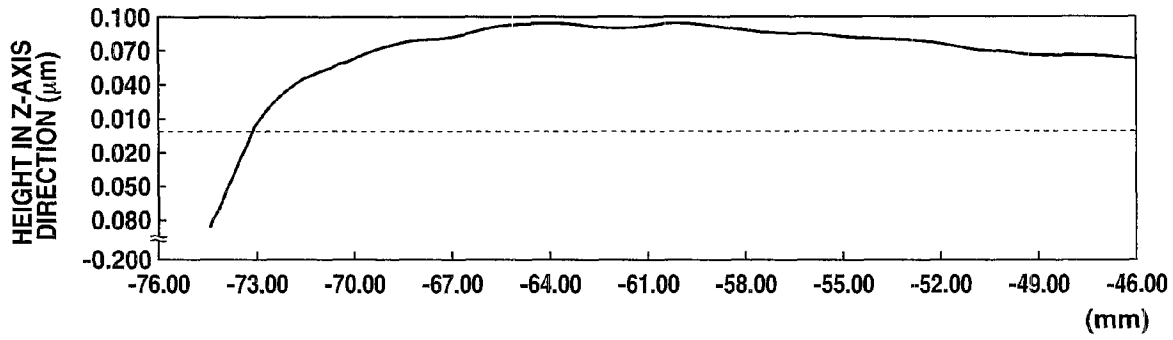
FIG. 4 is an example of a sectional view of a substrate surface shape.
Figure 5:
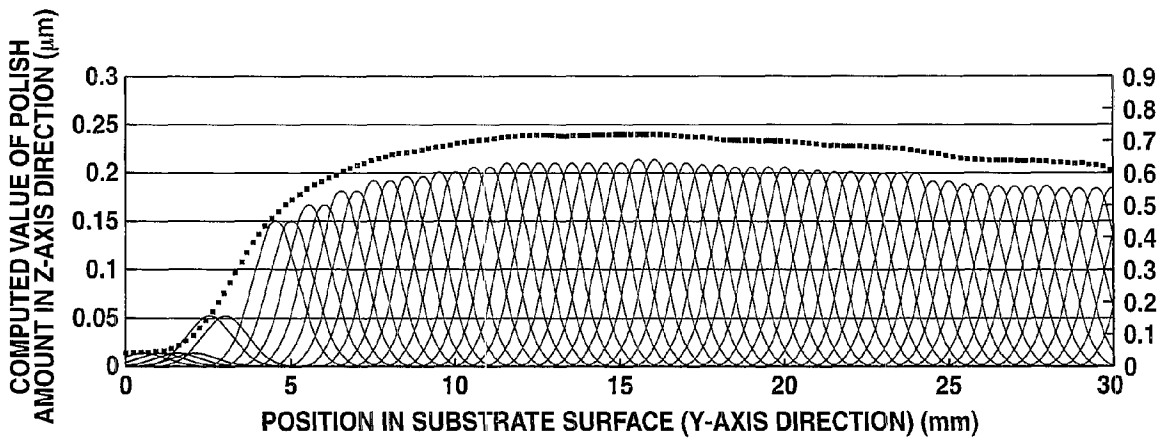
FIG. 5 is a sectional view derived by computation of processing amount through superposing the plots of Gaussian functions, for improving the flatness of the surface shape shown in FIG. 4.
Figure 6:
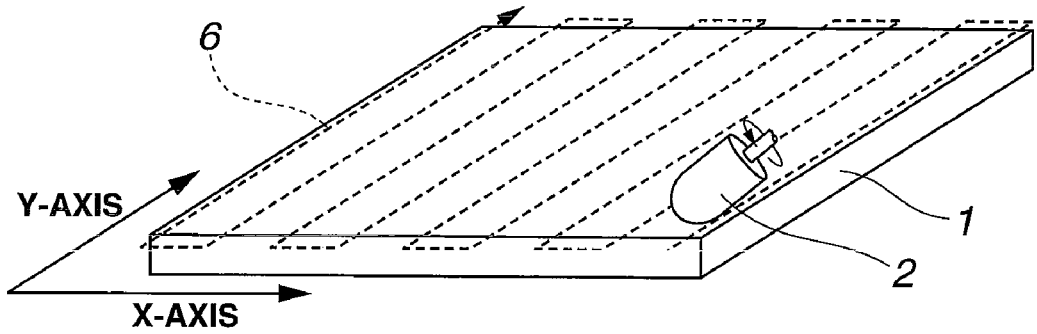
FIG. 6 is a schematic view illustrating another example of the mode of the movement of the processing tool of the partial polishing machine.
Figure 7:
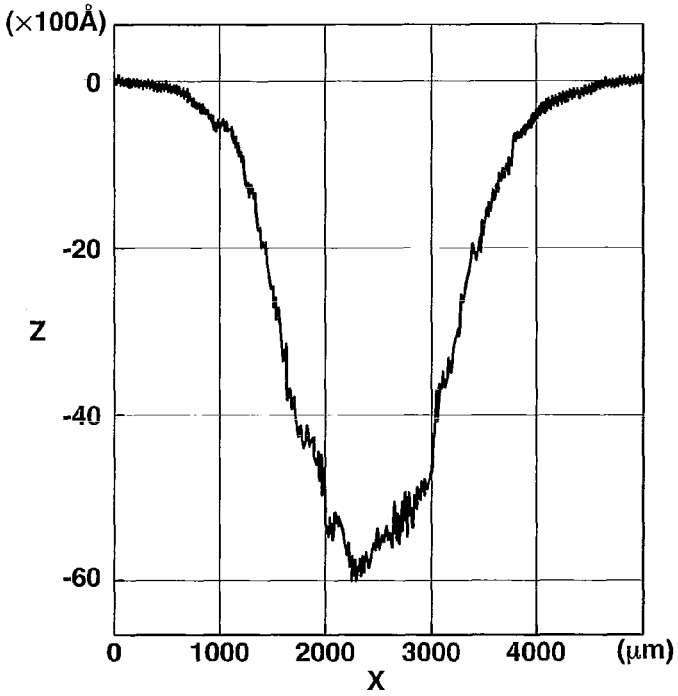
FIG. 7 is a diagram showing a section of processing obtained in the embodiment shown in FIG. 6.

Besides, after the processing is conducted by scanningly moving the rotary tool at a fixed speed in the X-axis direction while keeping constant its position in the Y-axis direction (incidentally, numeral 5 in the figure denotes the manner in which the processing tool is moved), the section of the substrate surface cut along the Y-axis direction is examined. As shown in FIG. 3, the examination result is a line-symmetrical profile such that the bottom of a dent is centered at the Y-coordinate at which the tool has been moved, the profile being able to be accurately approximated by a Gaussian function. By superposing successive runs of this process at a fixed pitch in the Y-direction, flatness-improving processing can be achieved, on a computation basis. For instance, in the case of improving the flatness of a substrate having a surface shape as shown in FIG. 4 which is practically determined by flatness measurement, it is possible, by aligning the plots (indicated by solid lines) of Gaussian functions at a fixed pitch in the Y-axis direction and superposing the plots as shown in FIG. 5, to obtain a section plot (indicated by broken line) conforming substantially to the actually measured surface shape shown in FIG. 4. As a result, it becomes possible to perform a flatness-improving processing, on a computation basis. The height (depth) of the plots of the Gaussian functions arrayed in the Y-axis direction as shown in FIG. 5 differs depending on the actually measured values of the Z-coordinate at the respective Y-coordinates. However, the height (depth) can be controlled by regulating the scanningly moving speed and/or rotational speed of the processing tool. In the case where the direction of the straight line obtained by projecting the rotational axis of the processing tool onto the substrate surface is taken as the X-axis, if the rotary tool is scanningly moved at a fixed velocity in the Y-axis direction while keeping constant its position in the X-axis direction as shown in FIG. 6 (incidentally, numeral 6 in the figure denotes the manner in which the processing tool is moved), the section of the processed substrate surface would have an irregular shape as shown in FIG. 7. Specifically, minute steps would be present in the processed surface. In the case of such an irregular (or distorted) profile, it is difficult to accurately approximate the profile by use of a function or functions and to perform computation for superposition. Accordingly, improvement of flatness cannot be satisfactorily achieved even if such profiles are progressively superposed at a fixed pitch in the X-direction.

Figure 8:
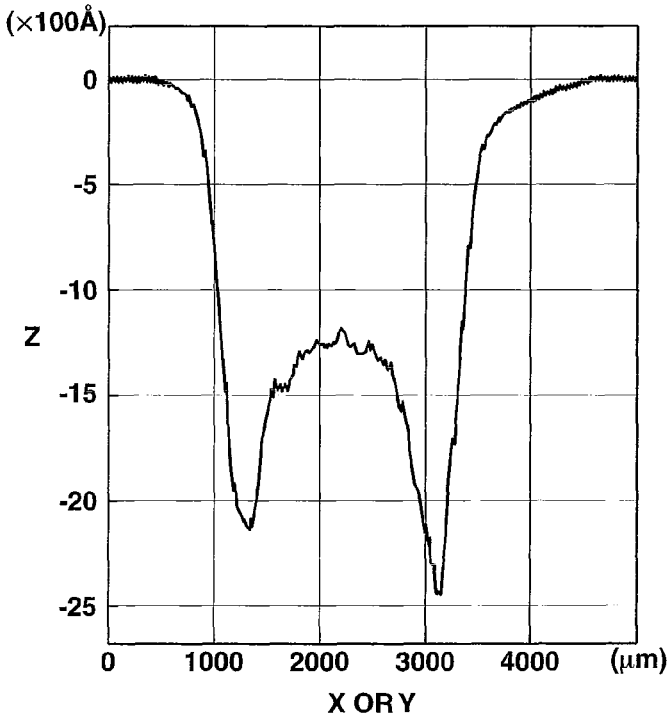
FIG. 8 is an example of a diagram showing a section of processing obtained in another embodiment of the partial polishing machine.

In addition, a case where the rotary processing tool is perpendicularly pressed against the substrate will be investigated. In this case, even if the rotary tool is for example scanningly moved in the Y-axis direction while keeping constant its position in the X-axis direction, the section of the substrate surface processed by the tool would have a shape as shown in FIG. 8 (the axis of abscissas is X in the case where the position of the tool in the X-axis direction is fixed; the axis of abscissas is Y in the case where the position of the tool in the Y-axis direction is fixed) wherein a central portion is slightly raised and outside-portions corresponding to a higher circumferential speed are deepened. Therefore, improvement of flatness cannot be well achieved even if such profiles are superposed, for the same reason as above-mentioned. Other than the above-mentioned procedures, an X-θ mechanism can also be adopted to perform the processing. However, the above-described method in which the rotary processing tool is put in contact with the substrate from an inclined direction relative to the substrate and is scanningly moved in the X-axis direction while keeping constant its position in the Y-axis direction, based on the assumption that the direction of a straight line obtained by projecting the rotational axis of the tool onto the substrate surface is taken as the X-axis, is more preferable for successfully obtaining an improved flatness.

As a method for putting the small-sized processing tool in contact with the substrate, there can be contemplated a method in which the tool is adjusted to such a height as to make contact with the substrate and the processing is conducted while keeping this height, and a method in which the tool is put in contact with the substrate while controlling the pressure thereon by air pressure control or the like. In this instance, the method in which the tool is put in contact with the substrate while keeping the pressure at a fixed level is preferable, since the method promises a stable polishing rate. Where it is attempted to put the tool in contact with the substrate while keeping the tool at a fixed height, the following problem arises. During the processing, the size of the tool may be gradually changed due to its abrasion or the like. As a result, the contact area and/or pressure varies, which leads to a variation in the polishing rate during the processing. Thus, it may become impossible to achieve the intended improvement of flatness.

In relation to a mechanism for progressing a flatness-improving process for a substrate surface having a protuberant profile according to the degrees of protuberance, the method of improving flatness by varying and controlling the moving speed of a processing tool while keeping constant the rotational speed of the processing tool and the contact pressure of the tool onto the substrate surface is mainly adopted in the present invention. However, improvement of flatness can also be performed by varying and controlling the rotational speed of the processing tool and the contact pressure of the tool onto the substrate surface.

In this case, the substrate after the polishing process can have a flatness $F_2$ of 0.01 to 0.5 μm, particularly 0.01 to 0.3 μm ($F_1>F_2$).

Incidentally, the processing by the processing tool may be applied only to one of the major surfaces of the substrate. However, the polishing by the processing tool may be applied to both sides (both major surfaces) of the substrate, whereby parallelism (thickness variation) of the substrate can be improved.

In addition, after the substrate surface is processed by the processing tool, the substrate may be subjected to single substrate processing type polishing or double side polishing, whereby surface properties and defect in quality of the final finished surface can be improved. In this case, in the step of polishing, performed after the polishing of the substrate surface by the processing tool, in order to improve the surface properties and defect in quality of the processed surface, the polishing step may be carried out by preliminarily determining the amount of polish by the small-sized rotary processing tool through taking into account a shape change expected to be generated in the process of the polishing step, whereby both an improved flatness and a high surface perfectness can be attained in the final finished surface.

To be more specific, the surface of the glass substrate obtained in the above-mentioned manner may show generation of surface roughening and/or a processed altered layer, depending on the partial polishing conditions, even when a soft processing tool is used. In such a case, polishing for an extremely short time such as not to produce a change in flatness may be carried out after the partial polishing, as required.

On the other hand, the use of a hard processing tool may result in that the degree of surface roughening is comparatively high or that the depth of a processed altered layer is comparatively large. In such a case, a method may be adopted in which how the surface shape will be changed by a subsequent finish polishing step is estimated according to the characteristics of the finish polishing, and the shape upon the partial polishing is so controlled as to cancel the estimated change in surface shape. For example, in the case where the substrate as a whole is expected to be convexed by the subsequent finish polishing step, the substrate may preliminarily be recessed by the partial polishing step under control so that a substrate surface with an improved flatness can be obtained upon the subsequent finish polishing step.

Besides, a control as follows may also be conducted. In the just-mentioned situation, in relation to surface shape change characteristics through the subsequent finish polishing step, the surface shapes before and after the finish polishing step are preliminarily measured by a surface shape measuring system while using a reserve substrate. Based on the measurement data, how the surface shape will be changed by the finish polishing step is analyzed by use of a computer. A shape reverse to the analyzed change in shape is added to an ideal plane shape, to form a tentative target shape. The partial polishing applied to the glass substrate to be a product is conducted aiming at the tentative target shape, whereby the final finished surface can be made to have a more improved flatness.

As has been described above, the synthetic quartz glass substrate which is an object of polishing in the present invention is obtained by subjecting a synthetic quartz glass ingot to forming (molding), annealing, slicing, lapping, and rough polishing. In the case where the partial polishing according to the invention is conducted by a comparatively hard processing tool, the glass substrate obtained by the rough polishing is subjected to the partial polishing according to the invention, to produce a surface shape with good flatness. Thereafter, the glass substrate obtained upon the partial polishing is subjected to precision polishing which determines the final surface quality, for the purpose of removing scratches (flaws) and/or a processed altered layer generated during the rough polishing and for the purpose of removing minute defects and/or a shallow processed altered layer generated during the partial polishing.

In the case where the partial polishing according to the present invention is performed by a comparatively soft processing tool, the glass substrate obtained by the rough polishing is subjected to precision polishing which determines the final surface quality, to remove scratches (flaws) and/or a processed altered layer which may be generated during the rough polishing. Thereafter, the partial polishing according to the invention is applied to the glass substrate, to form a surface shape with an improved flatness. Furthermore, precision polishing for a short time is additionally conducted for the purpose of removing extremely minute defects and/or an extremely shallow processed altered layer which may be generated during the partial polishing.

The synthetic quartz glass substrate polished by use of an abrasive according to the present invention can be used as a semiconductor-related electronic material, and, particularly, it can be preferably used for forming a photomask.

EXAMPLES

Now, the present invention will be described more in detail below by showing Examples and Comparative Examples, but the invention is not to be limited by the following Examples.

Example 1

Figure 9:
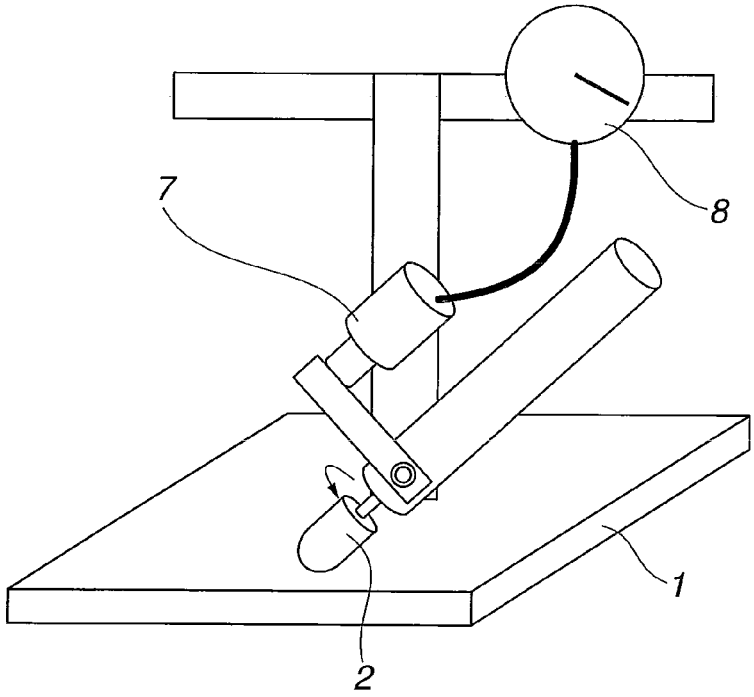
FIG. 9 is a schematic view illustrating the configuration of the partial polishing machine in the present invention.
Figure 10:
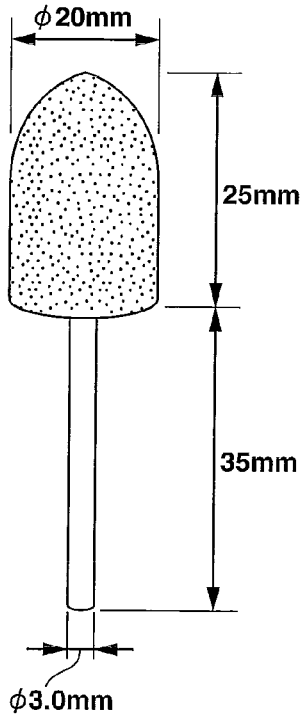
FIG. 10 is an illustration of a cannonball-shaped felt buff tool used in Examples.

A sliced silica synthetic quartz glass substrate raw material (6 in) was subjected to lapping by use of a double side lapping machine designed for sun-and-planet motion, and was subjected to rough polishing by use of a double side polishing machine designed for sun-and-planet motion, to prepare a raw material substrate. In this instance, the surface flatness of the raw material substrate was 0.314 μm. Incidentally, measurement of flatness was conducted by use of a flatness measuring system Ultra Flat M200, produced by Tropel Corp. Then, the glass substrate was mounted on a substrate holder of an apparatus shown in FIG. 9. In this case, the apparatus had a structure in which a processing tool 2 is attached to a motor and can be rotated, and a pressure can be pneumatically applied to the processing tool 2. In FIG. 9, numeral 7 denotes a pressing precision cylinder, and numeral 8 denotes a pressure controlling regulator. As the motor, a small-sized grinder (produced by Nihon Seimitsu Kikai Kosaku Co., Ltd.; motor unit: FPM-120, power unit: LPC-120) was used. Besides, the processing tool can be moved in X-axis and Y-axis directions, substantially in parallel to the substrate holder. As the processing tool, one in which a polishing part is a cannonball-shaped felt buff tool (F3620, produced by Nihon Seimitsu Kikai Kosaku Co., Ltd.; hardness: A90) shown in FIG. 10, measuring 20 mm in diameter by 25 mm in length, was used. The tool has a mechanism in which it is pressed against the substrate surface from a slant direction at an angle of about 30° to the substrate surface, the contact area being 7.5 $mm^2$.

Next, the processing tool was moved on the work under a rotational speed of 4,000 rpm and a processing pressure of 20 $g/mm^2$, to process the whole substrate surface. In this case, an aqueous dispersion of colloidal silica was used as a polishing fluid. The processing was conducted by a method in which, as shown in FIG. 2, the processing tool is continuously moved in parallel to the X-axis, and is moved at a pitch of 0.25 mm in the Y-axis direction. The processing rate under these conditions was preliminarily measured to be 1.2 μm/minute. The moving speed of the processing tool was set to 50 mm/second at the lowest substrate portion in the substrate shape. As for the moving speed at each of substrate portions, the required dwelling time for the processing tool at each substrate portion was determined, the moving speed at each substrate portion was computed from the required dwelling time, and the processing tool was moved at the computed moving speed at each substrate portion. The processing time was 62 minutes. After the partial polishing treatment, the flatness was measured by the same system as above, to be 0.027 μm.

Thereafter, the glass substrate was fed to final precision polishing. A soft suede polishing cloth was used, and an aqueous dispersion of colloidal silica having an $SiO_2$ concentration of 40 wt % was used as an abrasive material. The polishing was conducted under a polishing load of 100 gf, the removal amount being set at not less than 1 μm, which is a sufficient amount for removing the scratches (flaws) generated during the rough polishing step and the partial polishing step.

After the polishing was over, the glass substrate was washed and dried, and its surface flatness was measured, to be 0.070 μm. Defect inspection was conducted by use of a laser confocal optical high-sensitivity defect inspection system (produced by Lasertec Corporation). The number of 50-nm class defects was found to be 15.

Comparative Example 1

A sliced silica synthetic quartz glass substrate raw material (6 in) was subjected to lapping by use of a double side lapping machine designed for sun-and-planet motion, and was subjected to rough polishing by use of a double side polishing machine designed for sun-and-planet motion, to prepare a raw material substrate. In this instance, the surface flatness of the raw material substrate was 0.333 μm. Incidentally, measurement of flatness was conducted by use of a flatness measuring system Ultra Flat M200, produced by Tropel Corp. Then, the glass substrate was mounted on a substrate holder of an apparatus shown in FIG. 9. In this case, the apparatus had a structure in which a processing tool is attached to a motor and can be rotated, and a pressure can be pneumatically applied to the processing tool. As the motor, the small-sized grinder (produced by Nihon Seimitsu Kikai Kosaku Co., Ltd.; motor unit EPM-120, power unit: LPC-120) was used. Besides, the processing tool can be moved in X-axis and Y-axis directions, substantially in parallel to the substrate holder. As the processing tool, one in which a polishing part having an exclusive-use felt disc (A4031, produced by Nihon Seimitsu Kikai Kosaku Co., Ltd.; hardness: A65) adhered to a toroidal soft rubber pad (A3030, produced by Nihon Seimitsu Kikai Kosaku Co., Ltd.) having an outside diameter of 30 mmϕ and an inside diameter of 11 mmϕ, was used. The tool has a mechanism in which it is perpendicularly pressed against the substrate surface, the contact area being 612 $mm^2$.

Next, the processing tool was moved on the work under a rotational speed of 4,000 rpm and a processing pressure of 0.33 $g/mm^2$, to process the whole substrate surface. In this case, an aqueous dispersion of colloidal silica was used as a polishing fluid. The processing was conducted by a method in which, as shown in FIG. 2, the processing tool is continuously moved in parallel to the X-axis, and was moved at a pitch of 0.5 mm in the Y-axis direction. The processing rate under these conditions was preliminarily measured to be 1.2 μm/minute. The moving speed of the processing tool was set to 50 mm/second at the lowest substrate portion in the substrate shape. As for the moving speed at each of substrate portions, the required dwelling time for the processing tool at each substrate portion was determined, the moving speed at each substrate portion was computed from the required dwelling time, and the processing tool was moved at the computed moving speed at each substrate portion. The processing time was 62 minutes. After the partial polishing treatment, the flatness was measured by the same system as above, to be 0.272 μm. Because of the processing tool of the perpendicular pressing mechanism and the large diameter of the polishing part, the processed section was irregularly shaped under the influence of differences in circumferential speed. In addition, the contact area was large, so that a portion on which pressure is locally exerted was generated on the peripheral side of the substrate. Consequently, the resulting surface shape showed a negative inclination toward the periphery, and the flatness was not so improved.

Thereafter, the glass substrate was fed to final precision polishing. A soft suede polishing cloth was used, and an aqueous dispersion of colloidal silica having an $SiO_2$ concentration of 40 wt % was used as an abrasive material. The polishing was conducted under a polishing load of 100 gf, the removal amount being set at not less than 1 μm, which is a sufficient amount for removing scratches (flaws) generated during the rough polishing step and the partial polishing step.

After the polishing was over, the glass substrate was washed and dried, and its surface flatness was measured, to be 0.364 μm. Defect inspection was conducted by use of the laser confocal high-sensitivity defect inspection system (produced by Lasertec Corporation). The number of 50-nm class defects was 21.

Example 2

A sliced silica synthetic quartz glass substrate raw material (6 in) was subjected to lapping by use of a double side lapping machine designed for sun-and-planet motion, and was subjected to rough polishing by use of a double side polishing machine designed for sun-and-planet motion, to prepare a raw material substrate. In this instance, the surface flatness of the raw material substrate was 0.328 μm. Then, the glass substrate was mounted on the substrate holder of the apparatus shown in FIG. 9. As the processing tool, one in which a polishing part having an exclusive-use felt disc (A4021, produced by Nihon Seimitsu Kikai Kosaku Co., Ltd.; hardness: A65) adhered to a 20 mmϕ soft rubber pad (A3020, produced by Nihon Seimitsu Kikai Kosaku Co., Ltd.) was used. The tool has a mechanism in which it is perpendicularly pressed against the substrate surface, the contact area being 314 $mm^2$.

Next, the processing tool was moved on the work under a rotational speed of 4,000 rpm and a processing pressure of 0.95 $g/mm^2$, to process the whole substrate surface. The processing was conducted by a method in which, as shown in FIG. 2, the processing tool is continuously moved in parallel to the X-axis as indicated by arrow, with the moving pitch in the Y-axis direction being 0.5 mm. The processing rate under these conditions was 1.7 mm/minute. With the other conditions set to be the same as in Example 1, a partial polishing treatment was conducted. The processing time was 57 minutes. After the partial polishing treatment, the flatness was 0.128 μm. Because of the processing tool of the perpendicular pressing mechanism, the processed section was irregularly shaped. In addition, the contact area was large, so that a portion on which pressure is locally exerted was generated on the peripheral side of the substrate. Consequently, the resulting surface shape showed a negative inclination on the peripheral side of the substrate. However, an improvement in flatness was observed, as compared with the case where the processing was conducted by use of the 30 mmϕ tool having the larger contact area (612 $mm^2$). Thereafter, final precision polishing was conducted in the same manner as in Example 1.

After the polishing was over, the glass substrate was washed and dried, and its surface flatness was measured, to be 0.240 μm. The number of 50-nm class defects was 16.

Example 3

A sliced silica synthetic quartz glass substrate raw material (6 in) was subjected to lapping by use of a double side lapping machine designed for sun-and-planet motion, and was subjected to rough polishing by use of a double side polishing machine designed for sun-and-planet motion, to prepare a raw material substrate. In this instance, the surface flatness of the raw material substrate was 0.350 μm. Then, the glass substrate was mounted on the substrate holder of the apparatus shown in FIG. 9. As the processing tool, one in which a polishing part having an exclusive-use felt disc (A4011, produced by Nihon Seimitsu Kikai Kosaku Co., Ltd.; hardness: A65) adhered to a 10 mmϕ soft rubber pad (A3010, produced by Nihon Seimitsu Kikai Kosaku Co., Ltd.) was used. The tool has a mechanism in which it is perpendicularly pressed against the substrate surface, the contact area being 78.5 $mm^2$.

Next, the processing tool was moved on the work under a rotational speed of 4,000 rpm and a processing pressure of 2.0 $g/mm^2$, to process the whole substrate surface. The processing was conducted by a method in which, as shown in FIG. 2, the processing tool is continuously moved in parallel to the X-axis as indicated by arrow, with the moving pitch in the Y-axis direction being 0.25 mm. The processing rate under these conditions was 1.3 mm/minute. With the other conditions set to be the same as in Example 1, a partial polishing treatment was conducted. The processing time was 64 minutes. After the partial polishing treatment, the flatness was 0.091 μm. Due to the processing tool of the mechanism of perpendicular pressing, the processed section was irregularly shaped. However, the size of the 10 mmϕ tool and the contact area of 78.5 mm are the smallest in the examples adopting the perpendicular pressing mechanism, and, accordingly, the flatness obtained was improved as compared with the cases where the larger 30 mmϕ or 20 mmϕ tool was used. Thereafter, final precision polishing was carried out in the same manner as in Example 1.

After the polishing was over, the glass substrate was washed and dried, and its surface flatness was measured, to be 0.162 μm. The number of 50-nm class defects was found to be 16.

Example 4

A raw material substrate was prepared in the same manner as in Example 1. In this instance, the surface flatness of the raw material substrate was 0.324 μm. Then, the glass substrate was mounted on the substrate holder of the apparatus shown in FIG. 9. As the processing tool, one in which a polishing part is a cannonball-shaped felt buff tool (F3620, produced by Nihon Seimitsu Kikai Kosaku Co., Ltd.; hardness: A90) measuring 20 mmϕ in diameter by 25 mm in length was used. The tool has a mechanism in which it is pressed against the substrate surface from an inclined direction at an angle of about 50° to the substrate surface, the contact area being 5.0 $mm^2$.

Next, the processing tool was moved on the work under a rotational speed of 4,000 rpm and a processing pressure of 30 $g/mm^2$, to process the whole substrate surface. In this instance, a cerium oxide abrasive material was used as a polishing fluid. The processing rate under these conditions was 1.1 mm/minute. With the other conditions set to be the same as in Example 1, a partial polishing treatment was conducted. In this case, the processing time was 67 minutes. After the partial polishing treatment, the flatness was measured, to be 0.039 μm. Thereafter, the glass substrate was fed to final precision polishing. A soft suede abrasive cloth was used, and an aqueous dispersion of colloidal silica having an $SiO_2$ concentration of 40 wt % was used as an abrasive material. The polishing was carried out under a polishing load of 100 gf, the removal amount being set at not less than 1.5 μm, which is a sufficient amount for removing scratches (flaws) generated during the rough polishing step and the partial polishing step.

After the polishing was over, the glass substrate was washed and dried, and its surface flatness was measured, to be 0.091 μm. The number of 50-nm class defects was 20.

Example 5

A raw material substrate was prepared in the same manner as in Example 1. In this instance, the surface flatness of the raw material substrate was 0.387 μm. Then, the glass substrate was mounted on the substrate holder of the apparatus shown in FIG. 9. As the processing tool, one in which a polishing part is a cannonball-shaped felt buff tool (F3620, produced by Nihon Seimitsu Kikai Kosaku Co., Ltd.; hardness: A90) measuring 20 mmϕ in diameter and 25 mm in length was used. The tool has a mechanism in which it is pressed against the substrate surface from an inclined direction at an angle of about 70° to the substrate surface, the contact area being 4.0 $mm^2$.

Next, the processing tool was moved on the work under a rotational speed of 4,000 rpm and a processing pressure of 38 $g/mm^2$, to process the whole substrate surface. In this instance, a cerium oxide abrasive material was used as a polishing fluid. The processing rate under these conditions was 1.1 mm/minute. With the other conditions set to be the same as in Example 1, a partial polishing treatment was conducted. In this case, the processing time was 71 minutes. After the partial treatment, the flatness was measured, to be 0.062 μm. Thereafter, the glass substrate was fed to final precision polishing. A soft suede abrasive cloth was used, and an aqueous dispersion of colloidal silica having an $SiO_2$ concentration of 40 wt % was used as an abrasive material. The polishing was carried out under a polishing load of 100 gf, the removal amount being set at not less than 1.5 μm, which is a sufficient amount for removing scratches (flaws) generated during the rough polishing step and the partial polishing step.

After the polishing was over, the glass substrate was washed and dried, and its surface flatness was measured, to be 0.111 μm. The number of 50-nm class defects was 19.

Example 6

A raw material substrate was prepared in the same manner as in Example 1. In this instance, the surface flatness of the raw material substrate was 0.350 μm. Then, the glass substrate was mounted on the substrate holder of the apparatus shown in FIG. 9. As the processing tool, one in which a polishing part is a cannonball-shaped grindstone with a cerium-containing shaft (a grindstone with a cerium oxide-impregnated spindle, produced by Mikawa Sangyo), measuring 20 mmϕ in diameter by 25 mm in length, was used. The tool has a mechanism in which it is pressed against the substrate surface from an inclined direction at an angle of about 30° to the substrate surface, with the contact area being 5 $mm^2$ (1 mm×5 mm).

Next, the processing tool was moved on the work under a rotational speed of 4,000 rpm and a processing pressure of 20 $g/mm^2$, to process the whole substrate surface. In this instance, a cerium oxide abrasive material was used as a polishing fluid. The polishing rate under these conditions was 3.8 mm/minute. With the other conditions set to be the same as in Example 1, a partial polishing treatment was conducted. In this case, the processing time was 24 minutes. After the partial polishing treatment, the flatness was measured, to be 0.048 μm.

Thereafter, the glass substrate was fed to final precision polishing. A soft suede abrasive cloth was used, and an aqueous dispersion of colloidal silica having an $SiO_2$ concentration of 40 wt % was used as an abrasive material. The polishing was conducted under a polishing load of 100 gf, with the removal amount set at not less than 1.5 μm, which is a sufficient amount for removing scratches (flaws) generated during the rough polishing step and the partial polishing step.

After the polishing was over, the glass substrate was washed and dried, and its surface flatness was measured, to be 0.104 μm. The number of 50-nm class defects was 16.

Example 7

A raw material substrate was prepared in the same manner as in Example 1. In this instance, the surface flatness of the raw material substrate was 0.254 μm. Incidentally, measurement of flatness was conducted by use of a flatness measuring system Ultra Flat M200, produced by Tropel Corp. Then, the glass substrate was mounted on the substrate holder of the apparatus shown in FIG. 9. In this case, the apparatus had a structure in which a processing tool 2 is attached to a motor and can be rotated, and a pressure can be pneumatically applied to the processing tool 2. As the motor, a small-sized grinder (produced by Nakanishi Inc.; spindle: NR-303, control unit: NE236) was used. Besides, the processing tool can be moved in X-axis and Y-axis directions, substantially in parallel to the substrate holder. As the processing tool, one in which a polishing part is a cannonball-shaped felt buff tool (F3520, produced by Nihon Seimitsu Kikai Kosaku Co., Ltd.; hardness: A90) measuring 20 mmϕ in diameter by 25 mm in length was used. The tool has a mechanism in which it is pressed against the substrate surface from an inclined direction at an angle of about 20° to the substrate surface, the contact area being 9.2 $mm^2$.

Next, the processing tool was moved on the work under a rotational speed of 5,500 rpm and a processing pressure of 30 $g/mm^2$, to process the whole substrate surface. In this case, an aqueous dispersion of colloidal silica was used as a polishing fluid. The processing was conducted by a method in which the processing tool is continuously moved in parallel to the X-axis, and is moved at a pitch of 0.25 mm in the Y-axis direction. The moving speed of the processing tool was set to 50 mm/second at the lowest substrate portion in the substrate shape. As for the moving speed at each of substrate portions, the required dwelling time for the processing tool at each substrate portion was determined, the speed of polishing by the tool was computed from the required dwelling time, and the processing tool was moved at the computed speed at each substrate portion. The processing time was 69 minutes. After the partial polishing treatment, the flatness was measured by the same system as above, to be 0.035 μm.

Thereafter, the glass substrate was fed to final precision polishing. A soft suede abrasive cloth was used, and an aqueous dispersion of colloidal silica having an $SiO_2$ concentration of 40 wt % was used as an abrasive material. The polishing was conducted under a polishing load of 100 gf, with the removal amount being set at not less than 1 μm, which is a sufficient amount for removing scratches (flaws) generated during the rough polishing step and the partial polishing step.

After all the polishing steps were over, the glass substrate was washed and dried, and its surface flatness was measured, to be 0.074 μm. When defect inspection was carried out by use of a laser confocal optical high-sensitivity defect inspection system (produced by Lasertec Corporation), the number of 50-nm class defects was nine.

Example 8

A sliced silica synthetic quartz glass substrate raw material (6 in) was subjected to lapping by use of a double side lapping machine designed for sun-and-planet motion, and was subjected to rough polishing by use of a double side polishing machine designed for sun-and-planet motion. Furthermore, the work was subjected to final finish polishing, with a removal amount of about 1.0 μm, which is a sufficient amount for removing scratches (flaws) generated during the rough polishing step, to prepare a raw material substrate. Then, the glass substrate was mounted on the substrate holder of the apparatus shown in FIG. 9. In this instance, the surface flatness of the raw material substrate was 0.315 μm. As the processing tool, one in which a polishing part is a cannonball-shaped soft polyurethane tool (D8000 AFX, produced by Daiwa Dyestuff Mfg. Co., Ltd.; hardness: A70) measuring 19 mmϕ in diameter by 20 mm in length was used. The tool has a mechanism in which it is pressed against the substrate surface from an inclined direction at an angle of about 30° to the substrate surface, the contact area being 8 $mm^2$ (2 mm×4 mm).

Next, the processing tool was moved on the work under a rotational speed of 4,000 rpm and a processing pressure of 20 $g/mm^2$, to process the whole substrate surface. In this instance, a colloidal silica abrasive material was used as a polishing fluid. The processing rate under these conditions was 0.35 mm/minute. With the other conditions set to be the same as in Example 1, a partial polishing treatment was conducted. In this case, the processing time was 204 minutes. After the partial polishing treatment, the flatness was measured, to be 0.022 μm.

Thereafter, the work was fed to final precision polishing. A soft suede abrasive cloth was used, and an aqueous dispersion of colloidal silica having an $SiO_2$ concentration of 40 wt % was used as an abrasive material. The polishing was carried out under a polishing load of 100 gf, with the removal amount being set at not less than 0.3 μm, which is a sufficient amount for removing scratches (flaws) generated during the partial polishing step.

After the polishing was over, the glass substrate was washed and dried, and its surface flatness was measured, to be 0.051 μm. The number of 50-nm class defects was 12.

Example 9

A raw material substrate was prepared in the same manner as in Example 1. In this instance, the surface flatness of the raw material substrate was 0.371 μm. Then, the glass substrate was mounted on the substrate holder of the apparatus shown in FIG. 9. The change in shape of the substrate during a last precision polishing step was estimated, and partial polishing was conducted aiming at such a shape as to cancel the estimated change in shape. It had been empirically known that the surface shape of the substrate tends to be projected through a final polishing step conducted using a soft suede abrasive cloth and colloidal silica. Specifically, it was empirically estimated that projecting by about 0.1 μm would occur in the case of a removal amount of 1 μm, and, based on this estimation, a partial polishing step was conducted aiming at a target shape being concaved by 0.1 μm. With the other conditions set to be the same as in Example 1, a partial polishing treatment was conducted. In this case, the processing time was 67 minutes. After the partial polishing treatment, the flatness was measured. The substrate surface had a concaved shape, higher on the peripheral side and lower at a central portion, and the flatness was 0.106 μm. Thereafter, the final precision polishing was carried out in the same manner as in Example 1.

After the polishing was over, the glass substrate was washed and dried, and its surface flatness was measured, to be 0.051 μm. The number of 50-nm class defects was 20.

Example 10

A raw material substrate was prepared in the same manner as in Example 1. In this instance, the surface flatness of the raw material substrate was 0.345 μm. Then, the glass substrate was mounted on the substrate holder of the apparatus shown in FIG. 9. The change in shape of the substrate estimated to be generated during a final precision polishing was computed by a computer, and partial polishing was conducted aiming at such a shape as to cancel the estimated change in shape. Specifically, it had been empirically known that the surface shape of the substrate tends to be projected during a final polishing step conducted using a soft suede abrasive cloth and colloidal silica. Ten reserve substrates were subjected to measurement of surface shape before and after a final polishing step. For each of the reserve substrate, the following computation was conducted by a computer. First, the data on the height in the surface shape before the final polishing was subtracted from the data on the height in the surface shape after the final polishing, to determine the difference in height. The differences for the ten substrates were averaged, to obtain the change in shape generated through the final polishing. The change in shape was a shape projected by 0.134 μm. Based on this, a shape recessed by 0.134 μm, which is obtained by reversing the computed shape projected by 0.134 μm, was used as a target shape in conducting a partial polishing step. The partial polishing step was conducted, with the other conditions set to be the same as in Example 1. In this case, the processing time was 54 minutes. After the partial polishing treatment, the flatness was measured. The substrate surface had a recessed shape, higher on the peripheral side and lower at a central portion, and the flatness was 0.121 μm. Thereafter, final precision polishing was conducted in the same manner as in Example 1.

After the polishing was over, the glass substrate was washed and dried, and its surface flatness was measured, to be 0.051 μm. The number of 50-nm class defects was 22.

Example 11

A raw material substrate was prepared in the same manner as in Example 1. In this instance, the surface flatness of the raw material substrate was 0.314 μm. Then, the glass substrate was mounted on the substrate holder of the apparatus shown in FIG. 9. In processing the whole substrate surface, no pressure controlling mechanism was used, and the height of the processing tool was so fixed that the tool made contact with the substrate surface. With the other conditions set to be the same as in Example 1, a partial polishing treatment was conducted. In this case, the processing time was 62 minutes. After the partial polishing treatment, the flatness was measured, to be 0.087 μm. Since the processing was conducted while keeping constant the height of the processing tool, the trend of shape before the partial polishing remained in the shape of the substrate surface in the latter half of the processing, and the flatness was somewhat bad. Thereafter, final precision polishing was conducted in the same manner as in Example 1.

After the polishing was over, the glass substrate was washed and dried, and its surface flatness was measured, to be 0.148 μm. The number of 50-nm class defects was 17.

Japanese Patent Application Nos. 2009-015542 and 2009-189393 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method of processing a synthetic quartz glass substrate, comprising putting a polishing part of a rotary small-sized processing tool having a rotational axis set in a direction inclined relative to a normal to the substrate surface in contact with a surface of the synthetic quartz glass substrate in a contact area of 1 to 500 $mm^2$, and scanningly moving the polishing part and substrate surface relatively while rotating the polishing part so as to polish the substrate surface, wherein the processing tool is put into reciprocating motion in a fixed direction on the substrate surface, and is advanced at a predetermined pitch in a direction perpendicular to the direction of the reciprocating motion on a plane parallel to the substrate surface, as the polishing proceeds, and wherein the reciprocating motion is performed in parallel to the direction of a projected line obtained by projecting the rotational axis of the processing tool onto the substrate.

2. The method according to claim 1, wherein the rotational speed of the processing tool is 100 to 10,000 rpm, and the processing pressure is 1 to 100 g/mm$^2$.

3. The method according to claim 1, wherein the polishing of the substrate surface by the polishing part of the processing tool is carried out while supplying abrasive grains.

4. The method according to claim 1, wherein the angle of the rotational axis of the processing tool against the normal to the substrate surface is 5 to 85°.

5. The method according to claim 1, wherein a section of processing by the rotary small-sized processing tool has a shape which can be approximated by a Gaussian profile.

6. The method according to claim 1, wherein the contact pressure of the processing tool against the substrate surface is controlled to a predetermined value in performing the polishing.

7. The method according to claim 1, wherein the flatness $F_1$ of the substrate surface immediately before the polishing by the processing tool is 0.3 to 2.0 μm, the flatness $F_2$ of the substrate surface immediately after the polishing by the processing tool is 0.01 to 0.5 μm, and $F_1>F_2$.

8. The method according to claim 1, wherein the hardness of the polishing part of the processing tool is in the range of A50 to A75, as measured according to JIS K 6253.

9. The method according to claim 1, wherein after the substrate surface is processed by the processing tool, single substrate type polishing or double side polishing is conducted so as to improve surface properties and defect in quality of a final finished surface.

10. The method according to claim 9, wherein in the step of polishing performed after the polishing of the substrate surface by the processing tool in order to improve the surface properties and defect in quality of the processed surface, the polishing step is carried out by preliminarily determining the amount of polish by the small-sized processing tool through taking into account a shape change expected to be generated in the process of the polishing step, so as to attain both an improved flatness and a high surface perfectness in a final finished surface.

11. The method according to claim 1, wherein the processing by the processing tool is applied to both sides of the substrate so as to reduce variation of thickness.

12. The method according to claim 1, wherein the angle of the rotational axis of the tool against the normal to the substrate is 10 to 85°.

13. The method according to claim 1, wherein the angle of the rotational axis of the tool against the normal to the substrate is 15 to 60°.

14. The method according to claim 1, further comprising the step of preliminarily measuring a surface shape of the glass substrate, prior to the step of putting the polishing part of the rotary small-sized processing tool in contact with the surface of the synthetic quartz glass substrate, so that a moving speed of the rotary processing tool can be computed based on the surface shape of the glass substrate.

* * * * *